US006568722B2

(12) United States Patent
Raffelsiefer et al.

(10) Patent No.: US 6,568,722 B2
(45) Date of Patent: May 27, 2003

(54) MOTOR-VEHICLE DOOR LATCH

(75) Inventors: Kurt Raffelsiefer, Velbert (DE); Marek Dragon, Waldbröl (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/920,613

(22) Filed: Aug. 1, 2001

(65) Prior Publication Data

US 2002/0017792 A1 Feb. 14, 2002

(30) Foreign Application Priority Data

Aug. 4, 2000 (DE) ..... 100 38 151

(51) Int. Cl.[7] ..... E05C 3/06
(52) U.S. Cl. ..... 292/216; 292/201
(58) Field of Search ..... 292/216, 201, 292/DIG. 23; 70/264

(56) References Cited

U.S. PATENT DOCUMENTS 4,932,277 A * 6/1990 Beaux ..... 74/89.15
5,181,754 A * 1/1993 Shibata ..... 292/216
5,238,274 A * 8/1993 Becker ..... 292/201
5,427,421 A * 6/1995 Hamaguchi ..... 292/216
5,531,488 A * 7/1996 Yoshikuwa ..... 292/216
5,538,298 A * 7/1996 Ikeda ..... 292/201
5,971,449 A * 10/1999 Rogers ..... 292/216

FOREIGN PATENT DOCUMENTS

| | | |
|---|---|---|
| DE | 296 08 002 | 8/1996 |
| DE | 196 32 781 | 2/1998 |
| DE | 299 13 464 | 1/2000 |
| EP | 0 475 037 | 7/1991 |

* cited by examiner

*Primary Examiner*—Gary Estremsky
(74) *Attorney, Agent, or Firm*—Herbert Dubno; Andrew Wilford

(57) ABSTRACT

A motor-vehicle door latch has a housing, a part displaceable relative to the housing to release the latch, and mechanism on the housing operable to displace the part and release the latch. An actuating lever is pivotal on the housing between an unactuated position and an actuated position and a locking lever is also pivotal on the housing between a locked position coupling the actuating lever with the mechanism to displace same and an unlocked position uncoupling the actuating lever from the mechanism. Respective formations directly formed on the actuating lever and on the locking lever are directly engageable with each other for displacing the locking lever into the unlocked position on displacement of the actuating lever into the actuated position.

8 Claims, 2 Drawing Sheets

MOTOR-VEHICLE DOOR LATCH

FIELD OF THE INVENTION

The present invention relates to a latch. More particularly this invention concerns a latch used in a motor vehicle.

BACKGROUND OF THE INVENTION

A standard motor-vehicle door latch has a housing attached to a door edge and holding a pivotal fork that can move between a latched position engaged around a bolt extending from a doorpost and a released or unlatched position allowing the latch to move relative to the bolt. When latched, the door is held closed, when unlatched or released it can be opened. As a rule the fork is retained in the latched position by a pawl which is pivotal to release the fork.

In turn this pawl is typically displaced by a release lever. An actuating lever typically moved by an inside and/or outside door handle is coupled through a mechanism with the release lever to operate same and unlatch the door. Another locking lever is connected to the mechanism and can, in a locked position, set the mechanism so no movement is transmitted from the actuating lever to the release lever and, in an unlocked position, set the mechanism so the actuating lever operates the release lever. This is described in detail in German utility model 299 13 464 published Jan. 20, 2000 and in European patent 0,475,037 published Oct. 6, 1993.

In a central-locking system such as described in German patent 196 32 781 the locking lever can be moved between its locked and unlocked positions by a servomotor that is controlled centrally. Thus all the vehicle's doors can be locked and unlocked simultaneously. In addition an antitheft function is added which in an antitheft-on mode prevents manual actuation of the door latches at least from inside the vehicle. Although normally even a locked door can be open from inside, in the antitheft-on mode this is impossible. Thus, for instance, a thief who breaks a vehicle window and reaches inside cannot open the vehicle door.

In order to make such a latch resistant to forced entry, it is necessary to provide a complex linkage between the part inside the door that is capable of unlocking the door and the appropriate mechanism. This linkage and the part operating it can be somewhat complex, thereby adding considerably to the cost of the latch. What is more the standard lock button or lever is susceptible to manipulation from outside, for instance by a wire inserted past the door seal, so such systems offer inadequate security.

Accordingly it is known from German utility model 296 08 002 published Aug. 22, 1996 to use the inside door handle to operate the locking mechanism. Thus when the door is locked a first actuation moves the locking lever into the unlocked position and a subsequent actuation opens the door. Such systems have the advantage of apparent simplicity, but are invariably reliant on complex linkages comprising quite a few moving parts.

OBJECTS OF THE INVENTION

It is therefore an object of the present invention to provide an improved motor-vehicle door latch.

Another object is the provision of such an improved motor-vehicle door latch which overcomes the above-given disadvantages, that is which accommodates, if necessary, an antitheft function and that is nonetheless of simple and inexpensive construction.

SUMMARY OF THE INVENTION

A motor-vehicle door latch has according to the invention a housing, a part displaceable relative to the housing to release the latch, and mechanism on the housing operable to displace the part and release the latch. An actuating lever is pivotal on the housing between an unactuated position and an actuated position and a locking lever is also pivotal on the housing between a locked position coupling the actuating lever with the mechanism to displace same and an unlocked position uncoupling the actuating lever from the mechanism. In accordance with the invention respective formations directly formed on the actuating lever and on the locking lever are directly engageable with each other for displacing the locking lever into the un-locked position on displacement of the actuating lever into the actuated position.

Thus with this system the locking lever and actuating lever are constructed that, when the locking lever is in the locked position, operation of the actuating lever will directly move the locking lever into the unlocked position. Otherwise such operation of the actuating lever in the unlocked position of the locking lever will have no effect at all. Once the actuating lever has been moved to unlock the latch, a subsequent actuation of the actuating lever will serve to actually release the latch and open the door. No complex linkages are needed, merely two formations on the actuating and locking levers that are position such that they are engageable with each other only when the locking lever is in the locked position. The actuating lever can be unitary with or linked to an inside door handle.

According to the invention the formations include a tongue formed directly on one of the levers and an abutment formed on the other of the levers. The levers are pivotal about respective axes and the tongue extends radially of the axis of the respective lever. Furthermore the abutment has a rounded edge directly engageable with the tongue. Thus the two parts slide silently and smoothly on each other.

According to the invention an antitheft system is connected with the mechanism to prevent coupling of the release lever with the part. Thus when the antitheft system is in the on condition, no matter how many times the actuating lever is operated the latch will not be released.

The mechanism according to the invention includes a coupling link carried on the locking lever. The antitheft system holds this coupling open.

The mechanism according to the invention includes a release lever formed with an L-shaped slot having one leg extending angularly of a pivot axis of the locking lever and another leg extending radially of the pivot axis and directly engageable with the part and a coupling lever slidable on the locking lever and having a pin engaged in the slot for, when engaged n the one leg, connecting the locking lever to the release lever and, when engaged in the other leg, for allowing the locking lever to pivot relative to the release lever.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
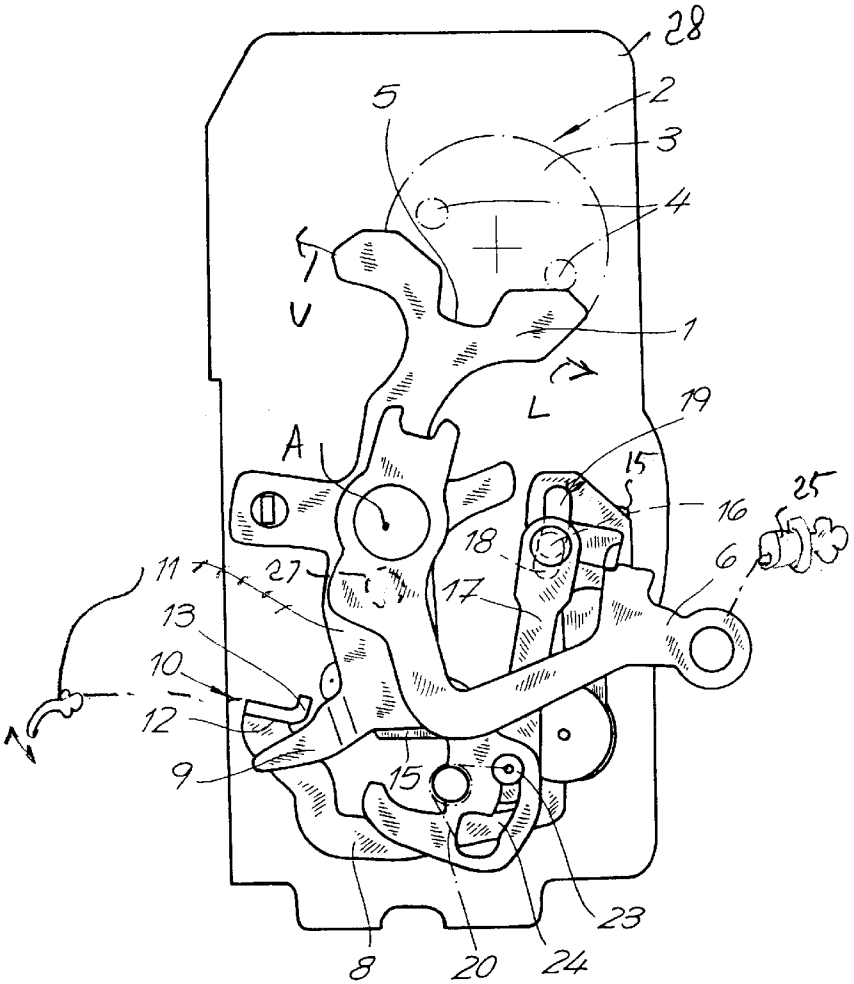
FIG. 1 is a partly diagrammatic side view of the latch according to the invention in the locked position.

As seen in FIG. 1 a latch in accordance with the invention has a housing 28 on which a main locking lever 1 is pivotal about an axis A. A central-lock drive 2 has a disk 3 provided with pins 4 capable of acting on a forked end 5 of the lever 1 to pivot it in a clockwise locking direction L into the position of FIG. 1 or a counterclockwise unlocking direction U, much as described in above-cited German 299 13 464. An unlocking lever 6 operable, for instance, by a key cylinder 25 accessible from outside the door carrying the latch housing 28 has a pin 27 engaged with lost motion in a hole 7 in the lever 1 for pivoting it between its locked (FIG. 1) and unlocked (FIGS. 2 through 4) positions. Thus the lever 1 can be moved between these positions either by the central-lock drive 2 or the lever 6.

An actuating lever 8 pivoted on the housing 28 at A' (FIG. 3) has one end connected to an inside door handle 11 and an opposite end formed with an L-shaped slot 19 through which engages a pin 16 fixed at an outer end of a coupling link 17 whose inner end has another pin 23 riding in a slot 24 of the locking lever 1. This slot 19 has one leg 19' extending generally angularly of the pivot axis A and another leg 19" extending radially thereof. The slot 24 extends mainly parallel to the leg 19' and a spring 20 braced between the pin 23 and the lever 1 urges the pin 23 and with it the lever 17 upward, parallel to the leg 19' of the L-slot 19 and crosswise to the leg 19" thereof. Another spring 26 (FIG. 3) continuously urges the lever 8 clockwise about the pivot axis A', which is parallel to but offset from the axis A.

An L-shaped release lever 15 pivoted at the axis A' has a lower arm engageable with a pin 14 of an unillustrated pawl that can be pushed down to free an unillustrated fork as is well known in the art. This fork can engage around an unillustrated bolt mounted on a doorpost to secure the door carrying the housing 28 closed. Thus counterclockwise pivoting of the lever 15 pushes down the pin 14 and unlatches the door. A slot 18 extending generally parallel to the slot leg 19' slidably receives the pin 16 which, therefore extends from the coupling link 17 through the slot 18 in the release lever 15 and the slot 19 in the actuating lever 8.

According to the invention the locking lever 1, which is basically formed as a shaped flat steel plate, has a laterally extending coupling formation or finger 9 offset from its plane and engageable with a stop 10 formed on the actuating lever 8 and having a bottom surface 12 and an edge surface 13. Of course according to the invention the finger 9 could be formed on the lever 8 and the stop 10 on the lever 1 with the same effect described below.

Figure 2:
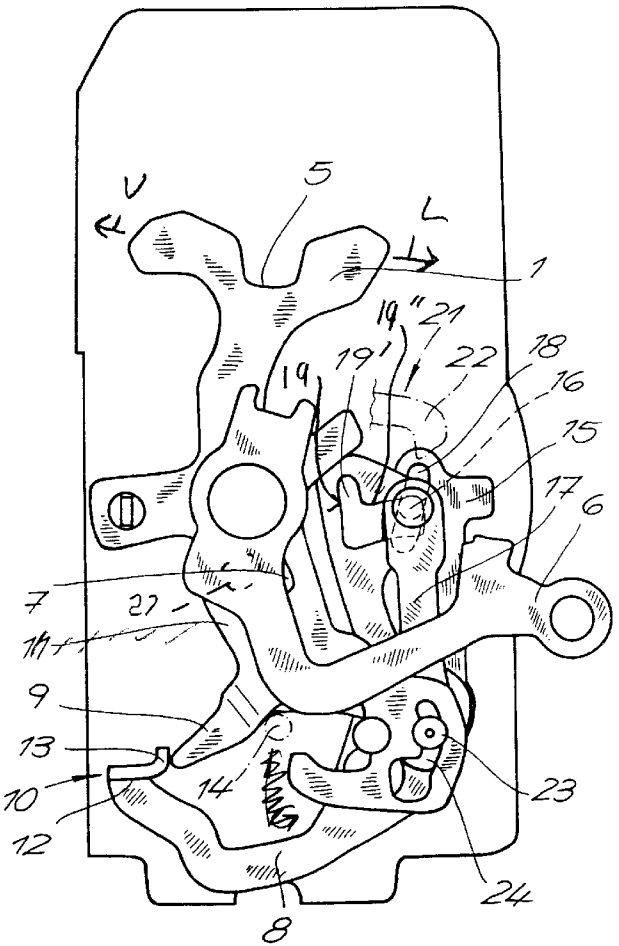
FIG. 2 is a view like FIG. 1 with the latch in the unlocked position toward the very end of a first actuation of the latch.
Figure 4:
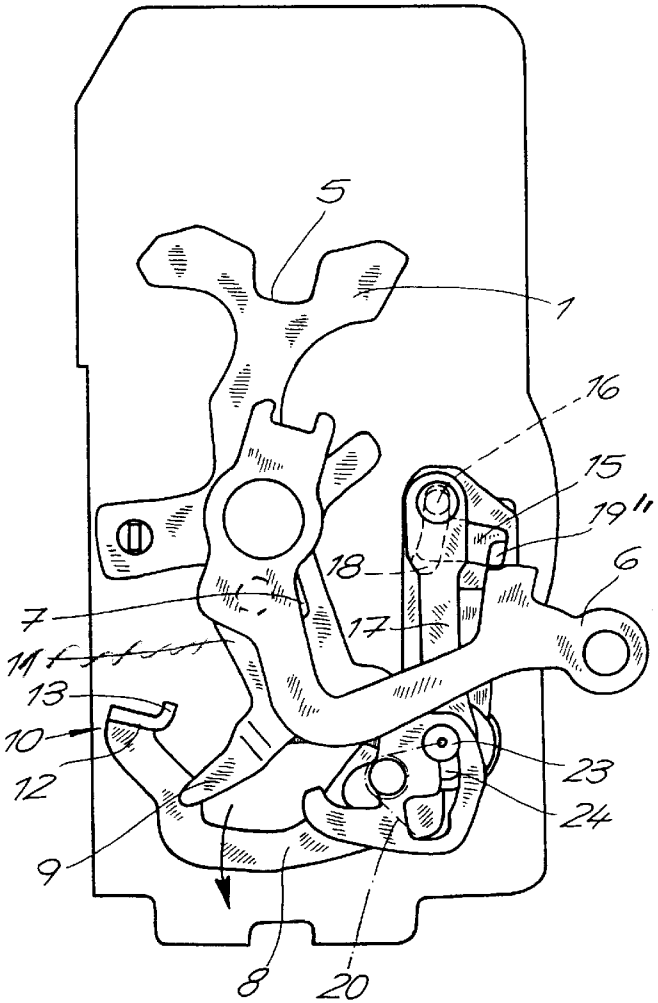
FIG. 4 is a view like FIG. 1 during a second actuation of the latch.
Figure 3:
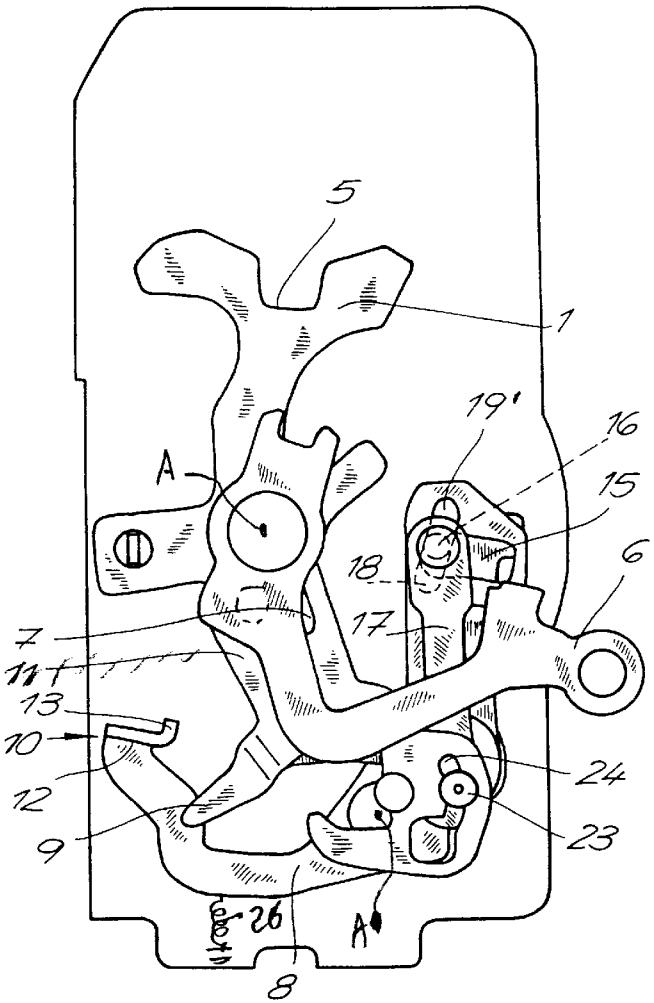
FIG. 3 is a view like FIG. 1 immediately after the first latch actuation.

An antitheft mechanism 21 has a part 22 that can engage down into the path of the pin 16 and prevent it from rising from the lower uncoupling position of FIGS. 1 through 3 to the upper coupling position of FIG. 4. In the lower uncoupling position the pin 16 can slide along the leg 19" of the slot 19 so that counterclockwise pivoting of the lever 8 will not be transmitted by the pin to the lever 15, but in the upper coupling position with the pin 16 engaged in the leg 19' the levers 8 and 15 will be coupled together for joint pivoting.

This apparatus functions as follows:

When the latch is locked as shown in FIG. 1 the coupling link 17 is in its lower position and the pin 16 is aligned with the transverse leg 19" of the slot 19, that is it is in the uncoupling position. Pivoting of the lever 8 will not cause the lever 15 to pivot and unlatch the door.

Nonetheless if the lever 8 is pivoted counterclockwise, for instance by the handle 11, the surface 12 of the abutment 10 will engage the finger 9 as shown in FIG. 2 and will pivot the lever 1 in direction U into the unlocked position. In this position the pin 23 pulls down away from the upper end of its slot 24 because upward movement of the lever 17 is blocked by the upper surface of the slot 19". The spring 20 is therefore compressed and urges the lever 17 upward and presses the pin against the upper edge of this slot leg 19".

When subsequently the lever 8 is released to return under the force of its spring 26 to the FIG. 1 rest or unactuated position, the pin 16 moves into alignment (FIG. 3) with the other leg 19' of the slot 19 and slides upward, seating in its upper end (FIG. 4) and assuming the coupling position.

Subsequent reactuation of the handle 11 will again pivot the lever 8 but this time its movement will be transmitted by the pin 16 to the lever 15 to release the latch and open the door.

Of course if during any actuation of the lever 8 the antitheft part 22 is in the antitheft-on position blocking upward travel of the pin 16, no coupling of the lever 8 to the lever 15 is possible so that, no matter how many times the handle 11 is actuated, the door will stay latched. In the antitheft-on position the lever 8 is effectively disconnected from the lever 15.

We claim:

1. In combination with an inside motor-vehicle door handle, a motor-vehicle door latch comprising:

a housing;

a part displaceable relative to the housing to release the latch;

mechanism including a coupling link operable to displace the part and release the latch;

an actuating lever connected to the handle and pivotal on the housing by the handle between an unactuated position and an actuated position;

a locking lever carrying the coupling line and pivotal on the housing between an unlocked position coupling the actuating lever with the mechanism to displace same and a locked position uncoupling the actuating lever from the mechanism; and respective formations directly formed on the actuating lever and on the locking lever and directly engageable with each other for displacing the locking lever into the unlocked position on displacement of the actuating lever into the actuated position.

2. The motor-vehicle door latch defined in claim 1 wherein the formations include a finger formed directly on one of the levers and an abutment formed on the other of the levers.

3. The motor-vehicle door latch defined in claim 2 wherein the levers are pivotal about respective axes and the finger extends radially of the axis of the respective lever.

4. The motor-vehicle door latch defined in claim 3 wherein the abutment has an edge directly engageable with the finger.

5. The motor-vehicle door latch defined in claim 1, further comprising antitheft means engageable with the mechanism to prevent coupling of the actuating lever with the part.

6. The motor-vehicle door latch defined in claim 1, further comprising antitheft means movable into an antitheft-on position for preventing the coupling link from operatively connecting the locking lever to the part.

7. The motor-vehicle door latch defined in claim 1 wherein the mechanism includes a release lever formed with an L-shaped slot having one leg extending angularly of a pivot axis of the locking lever and another leg extending radially of the pivot axis and directly engageable with the part; and a coupling lever slidable on the locking lever and having a pin engaged in the slot for, when engaged in the one leg, connecting the locking lever to the release lever and, when engaged in the other leg, for allowing the locking lever to pivot relative to the release lever.

8. A motor-vehicle door latch comprising:

a housing;

a part displaceable relative to the housing to release the latch;

an actuating lever pivotal on the housing between an unactuated position and an actuated position;

a locking lever pivotal on the housing between an unlocked position coupling the actuating lever with the mechanism to displace same and a locked position uncoupling the actuating lever from the mechanism;

mechanism on the housing operable to displace the part and release the latch, the mechanism including a release lever formed with an L-shaped slot having one leg extending angularly of a pivot axis of the locking lever and another leg extending radially of the pivot axis and directly engageable with the part, and a coupling lever slidable on the locking lever and having a pin engaged in the slot for, when engaged in the one leg, connecting the locking lever to the release lever and, when engaged in the other leg, for allowing the locking lever to pivot relative to the release lever; and respective formations directly formed on the actuating lever and on the locking lever and directly engageable with each other for displacing the locking lever into the unlocked position on displacement of the actuating lever into the actuated position.

* * * * *